United States Patent [19]

Weniger

[11] 4,059,276

[45] Nov. 22, 1977

[54] BOARD GAME

[76] Inventor: Robert W. Weniger, 401 Maryland Ave., Havertown, Pa. 19083

[21] Appl. No.: 657,090

[22] Filed: Feb. 11, 1976

[51] Int. Cl.[2] ..... A63F 3/00

[52] U.S. Cl. ..... 273/134 D; 273/131 K; 273/134 AT

[58] Field of Search ..... 273/134

[56] References Cited

U.S. PATENT DOCUMENTS

| | | | |
|---|---|---|---|
| 715,474 | 12/1902 | Gaylor | 273/134 D |
| 1,311,810 | 7/1919 | Gilmore | 273/134 D |
| 1,551,951 | 9/1925 | Hairbloom et al. | 273/134 E |
| 2,743,107 | 4/1956 | Hollossy | 273/134 D |
| 3,111,320 | 11/1963 | Acosta | 273/134 AD |

FOREIGN PATENT DOCUMENTS

| | | | |
|---|---|---|---|
| 638,957 | 6/1950 | United Kingdom | 273/131 KP |

*Primary Examiner*—Delbert B. Lowe

[57] ABSTRACT

A game which utilizes a flat game board containing two hundred and fifty-six squares some containing dollar amounts indicated thereon, some containing safe spaces and the rest blank. Fourteen pieces per player are used and dice determine the amount to be moved. Money is collected from a bank depending upon the amount on the square occupied. The person obtaining the most money wins the game.

6 Claims, 2 Drawing Figures

| | 300 | 400 | 500 | 600 | 700 | 800 | 1000 | 1000 | 800 | 700 | 600 | 500 | 400 | 300 | |
|---|---|---|---|---|---|---|---|---|---|---|---|---|---|---|---|
| 300 | 20 | | S | | | | | | | | | S | | 20 | 300 |
| 400 | | 40 | | | | | | | | | | | 40 | | 400 |
| 500 | S | | 60 | | | S | 16 | | S | | | 60 | | S | 500 |
| 600 | | | | 80 | | | | | | | 80 | | | | 600 |
| 700 | | 14 | | | 100 | | | | | 100 | | | 12 | | 700 |
| 800 | | | S | | | 160 | | | 160 | | | S | | | 800 |
| 1000 | | | | 16 | | | 200 | 200 | | | | | | | 1000 |
| 1000 | | | | | | | 200 | 200 | | | | | | | 1000 |
| 800 | | | S | | | 160 | | | 160 | | | S | | | 800 |
| 700 | | | | | 100 | | | | | 100 | 18 | 12 | | | 700 |
| 600 | | | | 80 | | | | | | | 80 | | | | 600 |
| 500 | S | | 60 | | | S | | | S | | | 60 | | S | 500 |
| 400 | | 40 | | | | | | | | | | | 40 | | 400 |
| 300 | 20 | | S | | | | | | | | | S | | 20 | 300 |
| | 300 | 400 | 500 | 600 | 700 | 800 | 1000 | 1000 | 800 | 700 | 600 | 500 | 400 | 300 | |

BOARD GAME

This invention relates to a parlor game and more particularly to a game which combines the use of a game board with movable pieces. In the past, typical board games provided squares critically arranged over substantially the entire surface area of the board and movable pieces designed to move in the squares. These pieces could be moved in any direction by the players after the players themselves established the separate paths of play which usually began and normally ended at different points on the board. Other typical games provided similar movable pieces on a board with definite and prescribed paths of travel for the pieces. The play would be begun by all players at the same set location on the board and play would continue this prescribed path until the game was ended.

The present invention provides the feature of having two or four players each with a total of fourteen movable pieces which in the beginning of the game occupy one entire side of the board. The board is constructed of a multitude of squares, some of which are blank and some which have markings thereon. Some of the squares are constructed as safe areas where a piece can safely rest without being interferred with. Other areas are marked with dollar amounts which indicate rewards for landing thereon.

The object of the present invention is to move pieces across the board, collecting as much money as possible while so doing.

Another object is to provide an entertaining means for persons to occupy their spare time.

A further object is the provision of a game that is inexpensive and easy to play.

The above objects as well as others together with the benefits and advantages of the invention will be apparent upon reference to the detailed description set forth below, particularly when taken in conjunction with the drawings appended hereto in which is shown a plan view of the game board with its markings thereon.

Figures 1, 2:
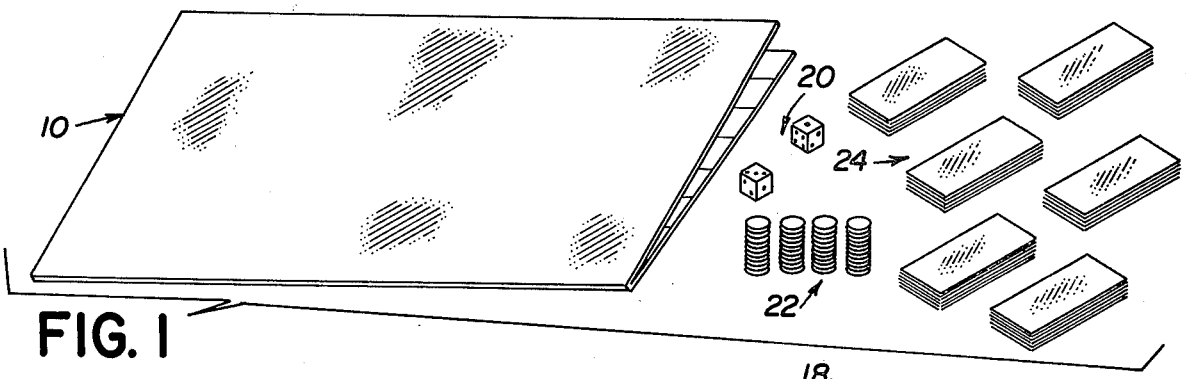
FIG. 1 illustrates a perspective view of all of the component parts of the instant invention.
FIG. 2 shows a plan view of the board portion of the present invention.

Referring now to the drawing, the board 10 contains a plurality of symmetrical squares 12 some of which are unmarked, such as 14, and others of which contain markings thereon. The squares marked with the letter S, such as 16, are safe areas, while the squares marked with numbers, such as 18, indicate dollar amounts.

The playing of the game is governed by the following rules:

The game may be played by two or four players. The players each receive fourteen pieces or chips 22 which he places on the first row of squares facing him. This is called his end line. The end line contains dollar markings in amounts from Three Hundred Dollars to One Thousand Dollars. A bank is established from which money 24 is taken depending on where the chips land. To determine the movement of the pieces a pair of dice 20 is provided which are first rolled to determine which player begins. The higher combination of numbers on the dice indicates which player moves first. Once this is established the first player rolls the dice and then proceeds to move any one of his fourteen pieces that distance that reads on the dice. The player can move the total of the dice forward, diagonally or sideways but cannot move backwards. The player can also elect to pass or to only move his piece the total distance as reflected on one of the dice only. At no time may a player move his piece more or less spaces then the dice indicate and no piece may move through any other piece on the board.

When a player's piece lands on any space marked with a dollar amount, he collects that amount of money from the bank. If a player's piece lands on a space already occupied by an opponent's piece, he may move his opponent's piece back to his opponent's starting place or end line and collect from him the amount of money marked in that space. When a player's piece has been removed from any space on the board and moved back to his end line, another piece or chip is placed on top of that piece. This indicates that should that piece of chip later land on a space that pays money or cross the board into an opponent's end line, that piece collects only one half of that amount to which it would otherwise be entitled. If that particular piece is later removed from a space a second time, another piece or chip is placed on top and that piece will then collect only one quarter of the money to which it otherwise would be entitled. If the same piece is removed a third time the piece is then removed completely from the game.

A player may not move through a space marked with a dollar amount to land on a space occupied by another player. If, however, his piece was adjacent to the space occupied by an opponent, he may then remove his opponent's piece and collect that amount of money from his opponent.

Spaces marked with "S" are safe spaces and no piece may be removed from these spaces.

When a player has moved any piece across the board and into an opponent's end line, he collects the amount of money indicated from the bank. Once a piece is occupying an end line space the piece may not be removed or moved. A player may not move any piece into the spaces on the corners of the board nor into an opponent's end line to the player's right or left, only into that opponent's end line directly opposite the player. If there are no empty spaces directly opposite a player he may move a piece into the corner spaces but collect no money. If the situation arises wherein there are no empty spaces on the opposite side of the board at all, a player may then remove an opponent's piece from his end line and collect from the bank the money indicated, but must place the opponent's piece on the player's own starting line in any unoccupied money space and the opponent collects that amount of money from the bank.

While a preferred embodiment of the present invention has been illustrated and described herein it is to be understood that other forms and embodiments might be adopted and still be within the spirit and scope of the disclosed invention. Therefore, it will be understood that the embodiment shown in the drawing and described herein is merely for illustration purposes and is not intended to limit the spirit and scope of the invention.

I claim:

1. a game comprising:

a square flat board including thereon four playing sides, a central area within said four playing sides containing a multitude of squares, each corner of said board being blank, squares along the sides of said central area being marked with different values, squares within the central area being marked with different values, said marked squares each having numerals designating the value of said square, four sets of manually movable playing pieces used in the central area, each set containing as many pieces as there are squares in each board line between the blank corner squares, means to determine the number of spaces a player's piece may be moved.

2. The invention in accordance with claim 1 wherein the game board contains a total of Two Hundred and Fifty-Six spaces.

3. The invention in accordance with claim 1 wherein some of the spaces are marked with the letter "S".

4. The invention in accordance with claim 1 wherein some of the spaces are blank.

5. The invention in accordance with claim 1 wherein the pieces are such that one can be stacked upon another.

6. The invention in accordance with claim 1 wherein the means to determine the number of spaces to be moved includes a pair of six sided cubes, each side of each cube containing a different number from one to six.

* * * * *